US005467991A

United States Patent [19]

White, IV et al.

[11] Patent Number: 5,467,991

[45] Date of Patent: Nov. 21, 1995

[54] DETACHABLE GOLF SWING TRAINING DEVICE USING TWO LIGHT BEAMS

[76] Inventors: Walter White, IV, 1039 Lenox Crest, Atlanta, Ga. 30324; Philip H. Burrus, IV, 4653 Arrowhead Trail, Lilburn, Ga. 30247

[21] Appl. No.: 212,984

[22] Filed: Mar. 15, 1994

Related U.S. Application Data

[63] Continuation-in-part of Ser. No. 148,497, Nov. 8, 1993, abandoned.

[51] Int. Cl.[6] ..... A63B 69/36

[52] U.S. Cl. ..... 273/186.3; 273/183.1

[58] Field of Search ..... 273/183.1, 186.3

[56] References Cited

U.S. PATENT DOCUMENTS

| | | | |
|---|---|---|---|
| 3,070,373 | 12/1962 | Mathews et al. | 273/186.3 |
| 3,820,795 | 6/1974 | Taylor | 273/186.3 |
| 3,863,933 | 2/1975 | Tredway | 273/186.3 |
| 3,953,034 | 4/1976 | Nelson | 273/186.3 |
| 4,456,257 | 6/1984 | Perkins | 273/186.3 |
| 4,693,479 | 9/1987 | McGwire | 273/186.3 |
| 5,165,691 | 11/1992 | Cook | 273/186.3 |
| 5,193,812 | 3/1993 | Hendricksen | 273/186.3 |
| 5,230,512 | 7/1993 | Tattershall | 273/186.3 |

*Primary Examiner*—Jessica J. Harrison

[57] ABSTRACT

The self-contained portable unit is attachable to and detachable from the shaft of a golf club and has a base mounting plate supporting a pair of light emitting diodes (LED) aimed in opposite directions parallel to the shaft of the club. The base plate supports removable batteries electrically connected through a switch to the LEDs; one LED is aimed downwardly towards the club head parallel to line of shaft and the other LED is aimed upwardly towards the handle end of the club parallel to line of shaft. Using a target line, such as the edge of a rug, a piece of string, or line on a hardwood floor, an imaginary ball is addressed in the normal fashion so that the light towards the head traces the target line and then once the club passes a parallel position the second light picks up the same target line while the swing is continued to the top of the swing.

7 Claims, 2 Drawing Sheets

DETACHABLE GOLF SWING TRAINING DEVICE USING TWO LIGHT BEAMS

This is a continuation-in-part of Ser. No. 08/148,497, filed Nov. 8, 1993, now abandoned.

FIELD OF THE INVENTION

A golf training device which is a portable unit detachable from and attachable to the shaft of a golf club and providing two oppositely directed light beams projecting to follow a straight line.

DESCRIPTION OF THE PRIOR ART

In our co-pending U.S. application Ser. No. 08/148,497 there is disclosed a GOLF SWING PLANE TRAINING DEVICE USING LIGHT BEAMS having LEDs aimed in opposite directions in line with the shaft and including a battery compartment and switch built into the club together with a special mat and method and procedure for using same. Of course, such an arrangement requires a special club which is not usable for normal playing. There is a demand for an attachable and detachable portable unit which can be used with any available golf club for practicing a golf swing.

The following U.S. patents disclose training units which can be attached to a golf club:

- U.S. Pat. No. 5,230,512 describes a jacket installed on the club head providing a mounting for a LED position with an elongated transparent grid plate.
- U.S. Pat. No. 3,820,795 discloses a unit which is readily attached to and detached from a golf club shaft to provide a light directed upwardly for the purpose of analysis of the golf swing.
- U.S. Pat. No. 3,953,034 discloses a laser beam unit which projects a light on a convex mirror located on the golf club head so that the golfer sees a line of sight on the ground for purposes of analysis.
- U.S. Pat. No. 3,070,373 discloses e unit attachable to project a beam of light in a downward direction to provide a visible indication on the ground of the movement of the club head.
- U.S. Pat. No. 3,106,403 discloses a club swing momentum indicator for providing signals upon reaching a predetermined momentum during the swinging of a club and employing a light as a visible signal.
- U.S. Pat. No. 3,863,933 discloses a light unit attachable to a golf club for projecting a beam of light for tracing a path on structure adjacent the golfer.
- U.S. Pat. No. 2,787,470 discloses a lighting attachment for golf club for projecting a beam of light on to the club head for illuminations the path of travel of the club head.
- U.S. Pat. No. 5,165,691 discloses a laser golf club putter assembly which may be mounted on the putter to provide a laser beam to aid in directing the golf ball.
- U.S. Pat. No. 5,193,812 discloses a laser beam emission attachment means to attach to a club head for alignment of the club face and the golf ball.

None of the above-noted patents discloses a unit which is attachable to and detachable from the shaft of a golf club to provide a pair of light beams for directing a first beam towards the club head parallel to the shaft and the second beam upwardly and in an opposite direction toward the end of the handle of the club parallel to the shaft. The club is swung back so as to trace a target line with the light aimed towards the head and then follow on through by continuing to trace the target line with the light aimed toward the end of the handle.

A significant advantage of the present invention resides in the portability whereby the unit can be easily carried in a bag or in a pocket.

Another advantage resides in the use of the device to approximate the swing plane of any club from driver to putter.

Another advantage resides in the arrangement of the unit whereby it can be used with any conventional golf club.

Still another advantage of the present device resides in the economy whereby the unit can be manufactured and sold at a reasonable price for use on any ordinary golf club.

SUMMARY OF THE INVENTION

A portable unit is detachable from and attachable to any golf club, preferably on the underside of the golf club shaft approximately one inch from the bottom of the grip. The attaching and detaching means may be "VELCRO" strips attached at one end to the unit and after encircling the golf club shaft attachable by adhering the "VELCRO" loops to the barbs. After installation the first light projects towards the club head parallel to the club shaft whereas the second light projects upwardly along the direction of the end of the club handle parallel to the club shaft. The unit is activated through the manual operation of a switch.

Accordingly, a typical unit employs a base upon which is mounted a battery compartment, a switch and the two LEDs pointing in opposite directions and connected together by electrical wires.

Other and further objects and advantages will become apparent upon reading the following Description of a Preferred Embodiment taken in conjunction with the accompanying drawings, in which.

DESCRIPTION OF A PREFERRED EMBODIMENT

Figure 1:
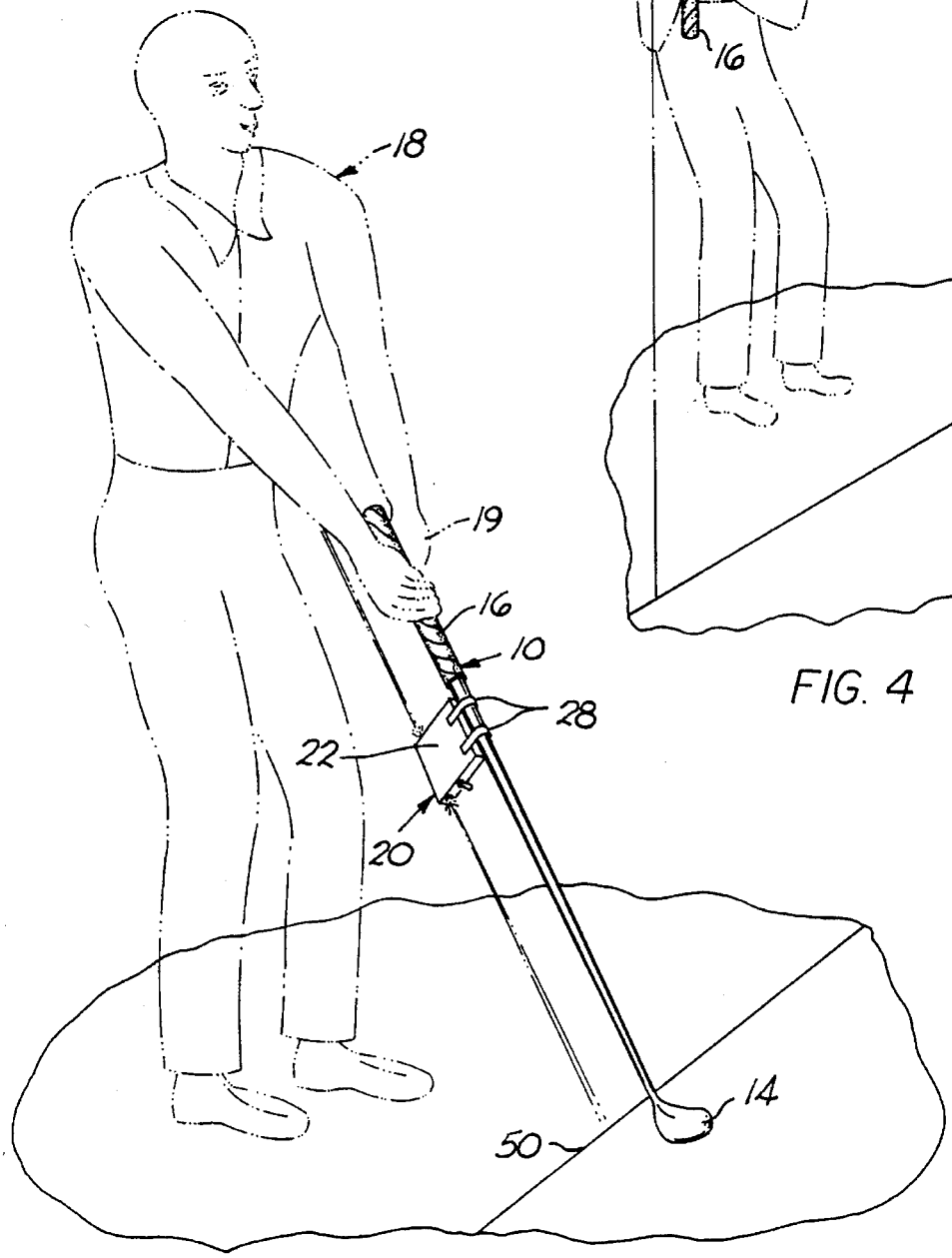
FIG. 1 is a diagrammatic perspective view of the unit mounted in place on a typical golf club held by a phantom golfer person and illustrating the two light beams shining in opposite directions towards a target line.
Figure 2:
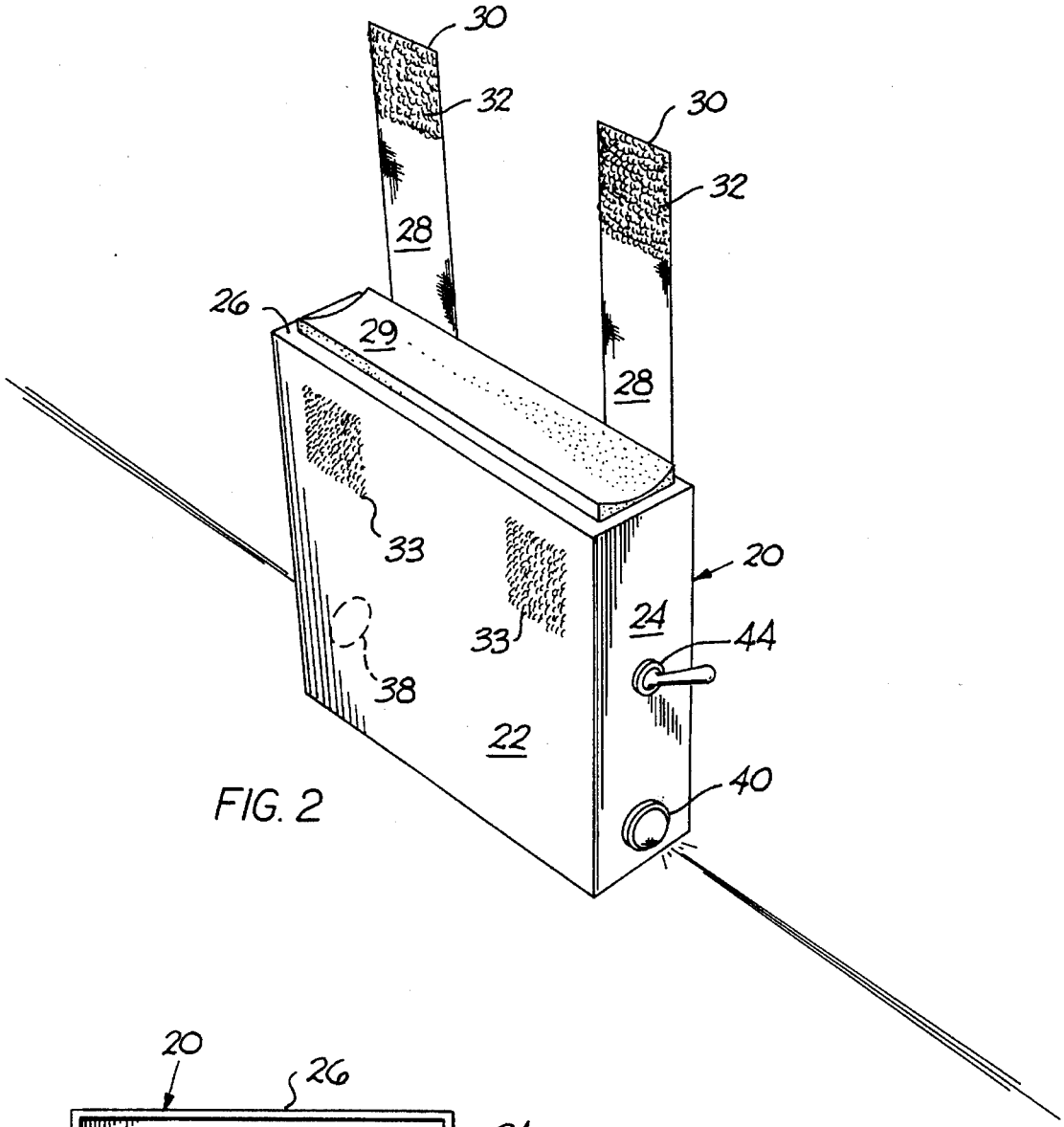
FIG. 2 is a perspective view of a detached unit with the "Velcro" strips open and showing the handle pad.

Referring initially to FIG. 1 and thence to the other figures of the drawings, a typical golf club 10 has a standard golf shaft 12 with a head 14 and a handle 16 held by a golfer 18 in hands 19.

Figure 3:
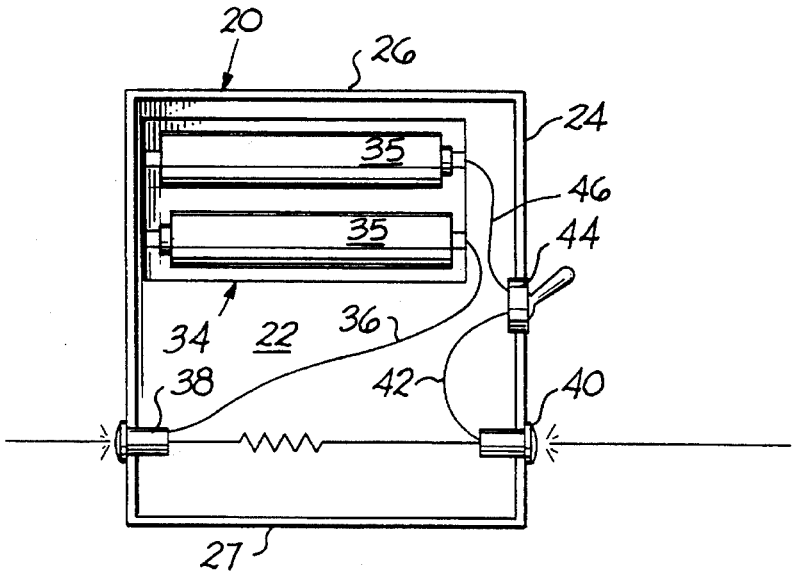
FIG. 3 is an elevation view of an open unit showing the two LEDs in an electrical wiring circuit.
Figure 5:
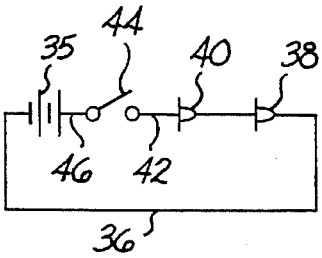
FIG. 5 is a schematic electrical diagram for the unit.

The unit 20 is attachable to any golf club, such as club 12 shown in FIG. 1, and comprises a plastic case having side walls 22, end walls 24, top walls 26 and bottom wall 27 which has pad 29 glued thereon. Two strips of "VELCRO" 28 have one end permanently attached (as for example by glue) to the side wall 22 of unit 20 and the other end 30 has the loops 32 for engagement and disengagement from the barbed strip 33 of the "VELCRO" which is glued or otherwise attached to the unit 20 on a side 22. Thus, it is easy to wrap the "VELCRO" strips 28 around the club shaft 12 and attach loops 32 to the "VELCRO" strips 33. Top wall 26 is compresses against pad 29 and club shaft 12. Referring to FIG. 3, unit 20 supports a battery compartment 34 in which may be located a pair of pen light batteries 35 mounted in series in a circuit which includes electrical wiring 36 having one portion extending to a first LED 38 and thence to a second LED 40 which in turn is connected by a wire 42 to switch 44 and thence through a wire 46 back to the battery compartment 34. When the unit 20 is not in use the switch 44 is operated to break the circuit and thereby cut-off the LEDs. If desired, of course the entire unit 20 may be easily removed from the club 10 and stored in a golf bag, utility bag or even in the pocket.

Procedure and Method of Use

Figure 4:
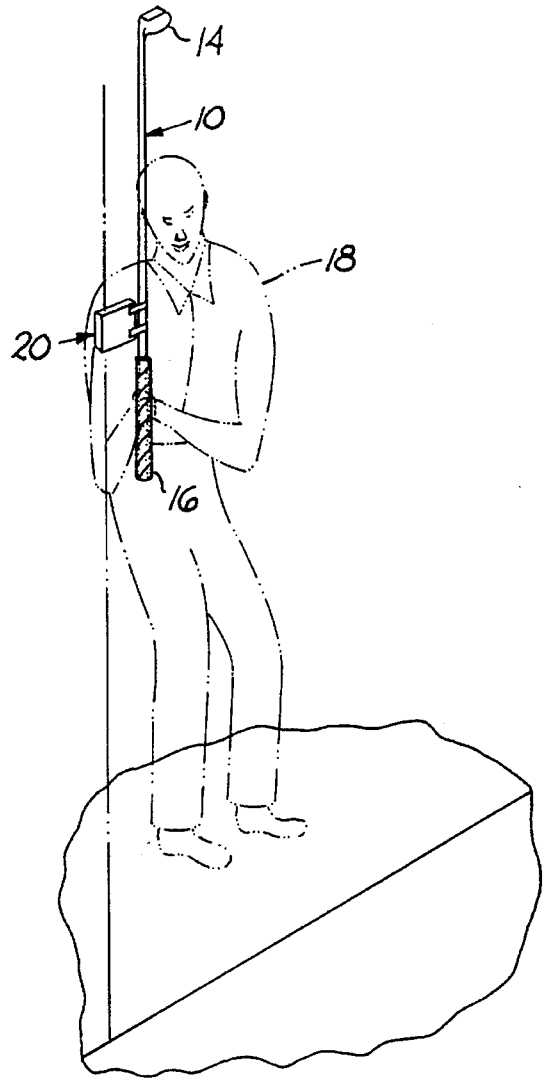
FIG. 4 is a diagrammatic perspective view of the phantom person in FIG. 1 using the unit on the club to follow the target line.

The present device 20 works on exactly the same principals and operation as disclosed in my co-pending application Ser. No. 08/148,497 mentioned previously. Accordingly, the directions for use in operation is exactly the same. Furthermore, the concept is based upon the principal of two intersecting lines determining a plane. Although a practice mat is not essential for use with the present device 20, it is used in exactly the same manner in that the golfer 18 swings the club 10 back and traces a target line 50 with one or the other of the LED 38, 40 lights both of which direct light parallel to the club shaft 12. Indeed, the target line 50 may even be imaginary or something readily available, such as the edge of a carpet. Also, a piece of string carried in the golf bag can be used as a long straight line facilitated simply by attaching same in the ground by means of a common golf tee at each end. Referring to the diagrammatic views of FIGS. 1 and 4, the phantom golfer 18 takes a normal address position so that the first LED 40 points at the target line 50 and the distance from the target line and stance depends upon the particular club being used and the shot being practiced. The club 10 is swung slowly backwards tracing the target line 50 with the first LED 40 so that the first LED 40 moves in a straight line but the club head 14 is actually moving back, up and in. Once the club 10 passes the parallel position the second LED 38 will pick-up the target line 50 which is traced until the club 10 reaches the top of the swing. Beginning the down-swing the second LED 38 will trace the target line 50 until the club 10 reaches parallel at which time the first LED 40 will then trace the target line 50 through impact and the follow-through. The second LED 38 will again trace the target line until the finish. The particular LED 38, 40 closest to the ground will always point at the target line 50 or an extension of the target line 50 so whenever a light from LED 38 or 40 is seen on the ground, the light from 38 or 40 should point at the target line 50. Furthermore, the swing should be only as fast as the lights from LED 38 or 40 can be perfectly aligned on the target line 50.

While there is shown a particular preferred embodiment of the invention together with a suggested mode of operation, this is by way of illustration only and does not constitute any limitation on the scope of the invention since there are various alterations, changes, eliminations and deviations in the invention and the use thereof which do not depart from the scope of the invention as defined only by proper interpretation of the appended claims.

The invention is claimed as follows:

1. In a portable and detachable golf swing plane practice device for use with a golf club having a club shaft on which is a head at one end and a handle at the other:

a portable unit comprising a base and a battery means on said base for supporting a removable battery, a switch on said base electrically connected to said battery means, a first light means mounted on said base for directing light in a direction parallel to said club shaft toward said club head, a second light means mounted on said base for directing light in a direction parallel to said club shaft toward said handle, electrical wiring for connecting said battery means, said switch, said first light means, and said second light means, means for attaching said entire unit on said club shaft and for readily detaching the same unit therefrom whereby said entire unit may be readily installed or removed from said club.

2. The device in claim 1, wherein said base and said battery means are contained in a housing and are supported therein.

3. The device in claim 1, wherein said first and said second light means comprises light emitting diodes (LEDs).

4. The device in claim 1, wherein said battery means comprises a dry cell battery, and said LEDs are mounted on opposite ends of said unit, and are electrically wired to said switch and said battery.

5. A method of teaching and practicing a proper golf swing comprising:

A) Providing a device as defined in claim 1;

B) Attaching said device to said club shaft in such a manner where said unit is attached to said club shaft near said handle and opposite said club head;

C) Addressing an arbitrary ball location, aiming at an arbitrary target, during a setup phase of a golf swing;

D) Defining a target line as a geometric line created by the two points: said ball location and said target location;

E) Executing the back swing phase of a golf swing tracing the target line in a first direction with said first light means until said first means of light disappears from the target line and said second light means projects onto said target line and traces said target line until the top of the swing stroke is reached;

F) Executing the downswing phase of a golf swing tracing said target line with said second light means in the second direction until said second light means disappears at which time the first beam of light projects on said target line and traces said target line through the time a golf ball would be struck;

G) Executing the follow-through phase of a golf swing tracing said target line with said first light means until said first light means disappears at which time said second light means projects on said target line and traces said target line until the finish position of the golf swing.

6. The method in claim 5 further including maintaining the golfer's hands, arms, and body rotate about their axis at the same revolutions per second.

7. The method in claim 5 further including maintaining that the back of the golfer's left hand (for right handed golfer) does not form an angle less than 180 degrees with the golfer's left forearm.

* * * * *